US009909079B2

(12) United States Patent
Li et al.

(10) Patent No.: US 9,909,079 B2
(45) Date of Patent: Mar. 6, 2018

(54) LUBRICATING OIL COMPOSITION FOR PROTECTION OF SILVER BEARINGS IN MEDIUM SPEED DIESEL ENGINES

(71) Applicants: Yue-Rong Li, Albany, CA (US); Kevin S. Castile, Richmond, CA (US); John Dominic Palazzotto, Castro Valley, CA (US)

(72) Inventors: Yue-Rong Li, Albany, CA (US); Kevin S. Castile, Richmond, CA (US); John Dominic Palazzotto, Castro Valley, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 14/057,788

(22) Filed: Oct. 18, 2013

(65) Prior Publication Data

US 2015/0111798 A1 Apr. 23, 2015

(51) Int. Cl.
*C10M 129/70* (2006.01)
*C10M 159/18* (2006.01)

(52) U.S. Cl.
CPC ..... *C10M 129/70* (2013.01); *C10M 159/18* (2013.01); *C10M 2207/281* (2013.01); *C10M 2207/282* (2013.01); *C10N 2230/06* (2013.01); *C10N 2240/102* (2013.01); *C10N 2260/14* (2013.01)

(58) Field of Classification Search
CPC ..... C10M 2227/061
USPC ..... 508/198, 199
See application file for complete search history.

(56) References Cited

U.S. PATENT DOCUMENTS

| | | | | |
|---|---|---|---|---|
| 3,036,003 | A | 5/1962 | Verdol et al. | |
| 3,172,892 | A | 3/1965 | Le Suer et al. | |
| 3,219,666 | A | 11/1965 | Norman et al. | |
| 3,272,746 | A | 9/1966 | Le Suer et al. | |
| 3,275,554 | A | 9/1966 | Wagenaar et al. | |
| 3,329,658 | A | 7/1967 | Fields et al. | |
| 3,438,757 | A | 4/1969 | Honnen et al. | |
| 3,449,250 | A | 6/1969 | Fields et al. | |
| 3,454,555 | A | 7/1969 | Van Der Voort et al. | |
| 3,565,804 | A | 2/1971 | Honnen et al. | |
| 3,586,629 | A | 6/1971 | Otto et al. | |
| 3,591,598 | A | 7/1971 | Traise et al. | |
| 3,666,730 | A | 5/1972 | Coleman | |
| 3,980,569 | A | 9/1976 | Pindar et al. | |
| 4,234,435 | A | 11/1980 | Meinhardt et al. | |
| 4,495,088 | A * | 1/1985 | Liston | 508/198 |
| 4,530,771 | A | 7/1985 | Nakano | |
| 4,541,941 | A | 9/1985 | Horodysky et al. | |
| 4,612,132 | A | 9/1986 | Wollenberg et al. | |
| 4,734,211 | A | 3/1988 | Kennedy | |
| 4,746,446 | A | 5/1988 | Wollenberg et al. | |
| 4,764,296 | A | 8/1988 | Kennedy | |
| 5,244,591 | A | 9/1993 | Middleton | |
| 5,302,304 | A | 4/1994 | Valcho | |
| 5,451,941 | A | 9/1995 | Lamazou et al. | |
| 5,629,272 | A | 5/1997 | Nakazato | |
| 5,716,912 | A | 2/1998 | Harrison et al. | |
| 6,165,235 | A | 12/2000 | Kolp et al. | |
| 6,372,696 | B1 | 4/2002 | Tipton | |
| 6,440,905 | B1 | 8/2002 | Epps et al. | |
| 6,451,745 | B1 | 9/2002 | Ward | |
| 6,790,813 | B2 | 9/2004 | Boffa | |
| 7,374,658 | B2 | 5/2008 | Rosenbaum et al. | |
| 7,875,576 | B2 | 1/2011 | Boffa | |
| 7,902,131 | B2 | 3/2011 | Aguilar et al. | |
| 8,071,515 | B2 | 12/2011 | Kamano et al. | |
| 8,367,591 | B2 | 2/2013 | Kamano | |
| 2003/0195126 | A1* | 10/2003 | Boons | C10M 159/22 508/460 |
| 2004/0102335 | A1* | 5/2004 | Carrick et al. | 508/192 |
| 2006/0111253 | A1 | 5/2006 | Harris | |
| 2006/0247138 | A1* | 11/2006 | Rosenbaum et al. | 508/110 |
| 2006/0276351 | A1 | 12/2006 | Mucha et al. | |
| 2007/0123437 | A1 | 5/2007 | Boffa et al. | |
| 2010/0081591 | A1* | 4/2010 | Yamaguchi et al. | 508/198 |
| 2012/0129743 | A1 | 5/2012 | Suen | |
| 2012/0266837 | A1* | 10/2012 | Barton | C10M 141/06 123/1 A |

FOREIGN PATENT DOCUMENTS

| | | |
|---|---|---|
| CA | 1137463 | 12/1982 |
| CA | 1157846 | 11/1983 |
| GB | 2303378 | 2/1997 |
| JP | 2010235851 | 10/2010 |
| WO | WO2012/177549 | 6/2011 |

OTHER PUBLICATIONS

PCT/US2014/43348, International Preliminary Report, dated Sep. 30, 2014, pp. 1-42.
Singapore Written Opinion.
Extended European Search Report.

* cited by examiner

*Primary Examiner* — Prem C Singh
*Assistant Examiner* — Frank C Campanell
(74) *Attorney, Agent, or Firm* — Carlton Virassammy

(57) ABSTRACT

Provided herein is a medium speed diesel engine crankcase lubricating oil composition comprising:

(a) a major amount of an oil of lubricating viscosity; and
(b) 0.15 to 2.0 weight percent of a silver lubricity borated fatty acid ester additive.

Also provided is a method for reducing silver bearing wear and friction in medium speed diesel engines comprising lubricating said engine with said lubricating oil composition.

7 Claims, No Drawings

LUBRICATING OIL COMPOSITION FOR PROTECTION OF SILVER BEARINGS IN MEDIUM SPEED DIESEL ENGINES

FIELD OF THE INVENTION

The present invention generally relates to a crankcase lubricating oil composition and a method for protection of silver bearings in medium speed diesel engines.

BACKGROUND OF THE INVENTION

Heavy duty diesel engines require crankcase lubricant oils which contain additives to stabilize oxidation, and which are non-corrosive to bearing materials including silver. Oxidation deterioration is undesirable because it can lead to decomposition of the engine lubricant. This deterioration of the lubricant has ramifications such as an increase in viscosity, the formation of sludge, and an increase in engine deposits. As the lubricant oxidizes it becomes more acidic and can cause corrosion of an engines' metal components such as bearing materials. In addition to utilizing additives to control oxidation, sludge, etc., care must be taken to ensure the additives themselves are not corrosive to metal components during engine operation.

Medium speed diesel engines are special because a significant number of railway diesel engines operated in the United States and other countries contain silver or silver surfaced bearing components. This poses a peculiar problem since many of the bearing protection additives which are effective at protecting other metal bearing surfaces, e.g. copper-lead, bronze, aluminium, are ineffective for protecting silver bearing components. In the case of materials such as zinc dithiophosphates, they are very corrosive to silver or silver-plated bearings.

Relatively high alkalinity in the lubricating oil is required to neutralize acids formed during the combustion process. However, some additives which contribute to high alkalinity, e.g., over-based phenates or sulfonates, are aggressive toward silver. This aggressive nature can result in excessive corrosion or wear of the silver-containing components of the engine. Therefore, a unique silver lubricity agent for medium speed diesel engines is needed as part of an intricate balance of additives to protect against the undesirable effects of lubricating oils on silver bearings.

A number of patents have disclosed lubricating oil compositions for silver protection, but none have provided the enhanced protection observed with the lubricating oil composition of the present invention.

U.S. Pat. No. 5,302,304 discloses a silver protective lubricant composition for an internal combustion engine, which contains the reaction product of an amine, formic acid, and a $C_5$ to $C_{60}$ carboxylic acid, a dispersant, metal detergent, and 0.01-1 wt. % of an organo-sulphur compound selected from sulphurised olefins, fatty acids or esters, sulphur-containing heterocyclic compounds, sulphurised hydroxy-aromatic compounds, disulphides, dithiocarbamates and thiadiazoles.

U.S. Pat. No. 5,244,591 discloses a lubricating oil composition for silver bearings wear reduction in internal combustion engine, which contains unsaturated carboxylic acid and no more than 0.08% wt sulfurized olefinic corrosion inhibitor. The sulfurized olefin comprises cosulfurized alkenyl ester-/alpha-olefin.

U.S. Pat. No. 4,734,211 discloses a lubricating oil composition for railway diesel engines which comprises a base oil, an ashless dispersant, an overbased alkaline earth metal akylphenolate, an alkaline earth metal alkyl sulfonate, an overbased alkaline earth metal phenolate, a polyhydroxy compound of up to 60 carbon atoms or a mixture, and a chlorinated hydrocarbon. The polyhydroxy compound comprises glycerol monooleate. The lubricating oil can reduce silver wear in marine and railway diesel engines.

U.S. Pat. No. 4,764,296 discloses a lubricating oil composition for railway diesel engines which comprises a base oil, an ashless dispersant, a mixture of overbased alkaline earth metal alkylphenolate and alkyl sulfonate compounds, a polyhydroxy compound of up to 60 carbon atoms or a mixture, and a chlorinated hydrocarbon. The polyhydroxy compound comprises glycerol monooleate. The lubricating oil can reduce silver wear in marine and railway diesel engines.

U.S. Pat. No. 4,495,088 discloses lubricating oil containing borated fatty acid esters of glycerol and a succinimide for internal combustion engine. Borated fatty acid ester of glycerol was found to be stabilized against hydrolysis in lubricating oil when used in conjunction with a succinimide compound. The borated fatty acid ester of glycerol is a mixture of borated glycerolmonooleate and glycerol dioleate. The combination of borated fatty acid ester of glycerol and succinimide has been found to reduce fuel consumption.

U.S. Pat. No. 8,071,515 discloses a lubricating oil composition for an internal combustion engine, in which a cylinder liner comprises cast iron or boron cast iron. The package comprises a baseoil, a fatty acid partial ester compound, an aliphatic amine compound and/or an acid amide compound, a benzotriazole derivative and a succinimide compound. The fatty acid partial ester could be a glycerol monooleate in 0.5-1.5% by mass based on the composition, and can react further with boron. The lubricating oil should have S<=0.3%, P<=0.12%, and SASH 1% based on the composition. The lubricating oil has enhanced friction reducing, oxidation stability and corrosion inhibiting effect.

U.S. Pat. No. 8,367,591 discloses a lubricating oil composition for an internal combustion engine. It contains sulfurated oxymolibdenum dithiocarbamate, acid amide, fatty acid partial ester/fatty-amine compound, and benzotriazole derivative. The fatty acid partial ester could be a borated glycerol monooleate in 0.3-0.6% by mass based on the composition. The lubricating oil has an excellent friction reducing and corrosion inhibiting effect for lead and copper.

US patent application number 20060111253 discloses a lubricating oil composition useful for crankcase internal combustion engine. It comprises base oil, ester of glycerol and higher carboxylic acid, and oil soluble molybdenum compound. The ester of glycerol and higher carboxylic acid could be a borated glycerol oleate. The lubricating oil has enhanced friction modification property.

US patent application number 20060276351 discloses an internal combustion engine lubrication package for improved fuel economy that comprises base oil, molybdenum salt, a borated epoxide, and monoester of polyol and aliphatic carboxylic acid. The monoester of polyol and aliphatic carboxylic acid comprises glycerol monooleate, and the borated epoxide has a specific structure with 300-1000 ppm boron to the composition.

U.S. Pat. No. 4,541,941 discloses a lubricating oil composition that comprises lubricating oil or grease, and a friction reducing amount of a borated mixture of a hydrocarbyl vicinal diol and hydroxyl-containing aliphatic carboxylate. The borated carboxylate could be borated glycerol monooleate.

Japanese patent application number 2010235851 discloses a lubricating oil composition for various applications. It contains base oil and a specific alkanoyl borate compound. The lubricating oil can achieve satisfactory wear resistance and oxidation stability, even when metal-free, phosphorus-free and sulfur-free additive are used.

U.S. Pat. No. 7,875,576 discloses a lubricating oil composition for internal combustion engine, which includes base oil, overbased detergent, oxymolybdenum complex, antioxidant, phosphorus compound and ester friction modifier. The ester friction modifier comprises borated glycerol monooleate.

U.S. Pat. No. 7,902,131 discloses a Mo-free and low P lubricating composition useful in engine oil that comprises base oil, diphnylamine compound, monoglyceride and/or ethoxylated amide and polyamine dispersant. The monoglyceride could be a borated epoxide or fatty epoxide.

Some of the patent art teach the use of sulfurized isobutylene in silver protecting lubricating formulation, and some teach the use of glycerol monooleate as silver lubricity agent. Although the use of borated glycerol monooleate as wear and/or corrosion inhibitors in internal combustion engines was mentioned in some art, none of the references teach borated glycerol monooleate as silver lubricity agent in railroad engine oil.

It is therefore desirable for crankcase lubricating oil compositions which protect silver bearings in medium speed diesel engines. It is also desirable for methods of lubricating medium speed diesel engines with crankcase lubricating oil compositions which protect silver bearings.

SUMMARY OF THE INVENTION

In accordance with one embodiment of the present invention, there is provided lubricating oil compositions which protect silver bearings and reduce friction in medium speed diesel engines. Also provided, is a method for reducing silver bearing wear and friction in medium speed diesel engines.

Among other factors, the present invention is based on the surprising discovery of lubricating oil compositions which reduce silver bearing wear and friction in medium speed diesel engines.

Definitions

The following terms will be used throughout the specification and will have the following meanings unless otherwise indicated.

The term "medium speed diesel engine crankcase lubricating oil composition" as used herein refers to a lubricating oil additive composition for engine oils used in medium speed diesel engines as commonly found in railroad locomotives, marine tugboats, and stationary power applications.

The term "silver protection" as used herein refers to the ability of the medium speed diesel engine crankcase lubricating oil composition of the present invention to protect silver and silver-plated bearings against wear in medium speed diesel engine crankcase.

The term "a major amount" of a base oil refers to where the amount of the base oil is at least 40 wt. % of the lubricating oil composition. In some embodiments, "a major amount" of a base oil refers to an amount of the base oil more than 50 wt. %, more than 60 wt. %, more than 70 wt. %, more than 80 wt. %, or more than 90 wt. % of the lubricating oil composition.

In the following description, all numbers disclosed herein are approximate values, regardless whether the word "about" or "approximate" is used in connection therewith. They may vary by 1 percent, 2 percent, 5 percent, or, sometimes, 10 to 20 percent.

DETAILED DESCRIPTION OF THE INVENTION

In general, provided herein is a medium speed diesel engine crankcase lubricating oil composition comprising:

(a) a major amount of an oil of lubricating viscosity; and
(b) 0.15 to 2.0 weight percent of a silver lubricity borated fatty acid ester additive.

Also provided is a method for reducing silver bearing wear and friction in a medium speed diesel engine by lubricating said engine with a lubricating oil composition comprising:

(a) a major amount of an oil of lubricating viscosity; and
(b) 0.15 to 2.0 weight percent of a silver lubricity borated fatty acid ester additive.

In one embodiment, the medium speed diesel engine is selected from the group comprising railroad locomotives, marine tugboats, and stationary power engines. In another embodiment, the medium speed diesel engine is a railroad locomotive engine. In another embodiment, the medium speed diesel engine is a marine tugboat engine. In another embodiment, the medium speed diesel engine is a stationary power engine.

In one embodiment, the medium speed diesel engine operates at 250 rpm to 1000 rpm.

In one embodiment, the medium speed diesel engine crankcase lubricating oil composition reduces silver bearing wear and friction in medium speed diesel engines.

In one embodiment, the silver lubricity additive is glycerol esters of fatty acids, such as oleic acid, typically prepared by reacting glycerol and a fatty acid. The product of this reaction is often referred to as, e.g., glycerol monooleate. However, in a typical commercial product, only about 50-60 mole percent of the esters produced are monoesters. The remainder is primarily diesters, with a small amount of triester. Furthermore, while the product is referred to as glycerol monooleate (because the starting acid was oleic acid), a typical commercial product contains esters of acids other than oleic acid, because the "oleic acid" used to prepare the ester is, in fact, a mixture of acids of which oleic acid may constitute only about 70 mole percent of the acids. Thus, a typical commercial "glycerol monooleate" may actually contain only about 38-40 mole percent glycerol monooleate. Canadian Patent Nos. 1,137,463 and 1,157,846, confirm this usage of the term "glycerol monooleate" when referring to a mixture of mono-, di, and/or esters.

The monoester or mixture of mono- and diesters is used in the present invention in an amount effective to reduce silver bearing wear and friction in a medium speed diesel engine. In one embodiment, the lubricating compositions of this invention contain at least 0.15, preferably 0.15 to 2.0 weight percent of the monoester or mixture of mono- and diesters.

Fatty acid esters of glycerol can be prepared by a variety of methods well known in the art. Many of these esters, such as glycerol monooleate and glycerol tallowate, are manufactured on a commercial scale. The esters useful for this invention are oil-soluble and are preferably prepared from $C_{12}$ to $C_{22}$ fatty acids or mixtures thereof such as are found in natural products. The fatty acid may be saturated or unsaturated. Certain compounds found in acids from natural sources may include licanic acid which contains one keto group. Most preferred $C_{16}$ to $C_{18}$ fatty acids are those of the formula R—COOH wherein R is alkyl or alkenyl. Preferred fatty acids are oleic, stearic, isostearic, palmitic, myristic, palmitoleic, linoleic, lanric, linolenic, and eleostearic, and the acids from the natural products tallow, palm oil, olive oil, peanut oil, corn oil, Neat's foot oil and the like. A particularly preferred acid is oleic acid.

The glycerol esters of the present invention are also prepared by reacting glycerol and a $C_{12}$-$C_{22}$ carboxylic acid containing 0 to 3 double bonds in a conventional manner well known in the art. Preferably the carboxylic acid contains one or less double bonds. The preferred acid is oleic acid. As with the commercial products described above, the resulting product is a mixture of mono-, di- and triesters.

The fatty acid monoester of glycerol is preferred, however, mixtures of mono- and diesters may be used. Preferably any mixture of mono- and diester contains at least 40% of the monoester. Typically these mixtures of mono- and diesters of glycerol contain from 40 to 60 percent by weight of the monoester. For example, commercial glycerol monooleate contains a mixture of from 45% to 55% by weight monoester and from 55% to 45% diester. However, higher monoester can be achieved by distilling the glycerol monoester, diester, triester mixture using conventional distillation techniques, with the monoester portion of the distillate product recovered. This can result in a product which is essentially all monoester. Thus, the esters used in the lubricating oil compositions of this invention may be all monoesters, or a mixture of mono- and diesters in which at least 75 mole percent, preferably at least 90 mole percent, of the mixture is the monoester.

In one embodiment, the silver lubricity additive of this invention is glycerol monooleate, glycerol dioleate, or mixtures thereof.

In one embodiment, the esters of this invention may also be borated. Boration passivates hydroxyl groups on the glycerol portion of the esters which helps improve compatibility with rubber seals. The borated product can be prepared by borating the ester with boric acid with removal of the water of reaction. Preferably, there is sufficient boron present such that each boron atom will react with from 1.5 to 2.5 hydroxyl groups present in the reaction mixture. The reaction may be carried out at a temperature in the range of 60° C. to 135° C., in the absence or presence of any suitable organic solvent such as methanol, benzene, xylenes, toluene, neutral oil and the like. A method for borating esters is disclosed in U.S. Pat. No. 4,495,088.

The borated esters of the present invention which meet the above-described requirements can be prepared, for example, as known in the art or by the following methods:

(A) Reacting carboxylic acid monoglyceride, glycerol, and boric acid at a temperature of 100° to 230° C.; or (B) Reacting glycerol and boric acid and further reacting the resulting compound with carboxylic acid, lower alcohol esters of carboxylic acids, or carboxylic acid halides; or (C) Reacting mixtures of carboxylic acid triglycerides, glycerol, and boric acid at a temperature of about 240° to 280° C.

In these methods, the respective starting materials are used in amounts satisfying the desired ratios of the boric acid residue, carboxylic acid residue, and glycerol residue in the final product. For instance, it is preferable to use 1 to 2 moles of carboxylic acid monoglycerides and 1 to 0 mole of glycerol per unit mole of boric acid in method (A), 2 moles of glycerol and 1 to 2 moles of carboxylic acids or their esters or halides per unit mole of boric acid in method (B), and 1 to 2 moles of carboxylic acid triglycerides and 4 to 5 moles of glycerol per 3 moles of boric acid in method (C).

In one embodiment, the lubricating compositions of this invention contain at least 0.15, preferably 0.15 to 2.0 weight percent of the silver lubricity borated fatty acid ester additive. In another embodiment, the lubricating compositions of this invention contain 0.15 to 1.5 weight percent, 0.15 to 1.0 weight percent, 0.15 to 0.50 weight percent, 0.15 to 0.25 weight percent, of the silver lubricity borated fatty acid ester additive. In another embodiment the lubricating compositions of this invention contain 0.20 weight percent of the silver lubricity borated fatty acid ester additive.

In one embodiment, the silver lubricity borated fatty acid ester additive of this invention is selected from the group comprising borated glycerol monooleate, borated glycerol dioleate, or mixtures thereof. In one embodiment the silver lubricity borated fatty acid ester additive is borated glycerol monooleate. In another embodiment the silver lubricity borated fatty acid ester additive is borated glycerol dioleate.

In many instances, it may be advantageous to form concentrates of the lubricating oil soluble additive composition of the present invention within a carrier liquid. These additive concentrates provide a convenient method of handling, transporting, and ultimately blending into lubricant base oils to provide a finished lubricant. Generally, the lubricating oil soluble additive concentrates of the invention are not useable or suitable as finished lubricants on their own. Rather, the lubricating oil soluble additive concentrates are blended with lubricant base oil stocks to provide a finished lubricant. It is desired that the carrier liquid readily solubilizes the lubricating oil soluble additive of the invention and provides an oil additive concentrate that is readily soluble in the lubricant base oil stocks. In addition, it is desired that the carrier liquid not introduce any undesirable characteristics, including, for example, high volatility, high viscosity, and impurities such as heteroatoms, to the lubricant base oil stocks and thus, ultimately to the finished lubricant. The present invention therefore further provides an oil soluble additive concentrate composition comprising an inert carrier fluid and from 2.0% to 90% by weight, based on the total concentrate, of an oil soluble additive composition according to the invention. The inert carrier fluid may be a lubricating oil.

These concentrates usually contain from about 2.0% to about 90% by weight, preferably 10% to 50% by weight of the oil soluble additive composition of this invention and may contain, in addition, one or more other additives known in the art and described below. The remainder of the concentrate is the substantially inert carrier liquid.

The Oil of Lubricating Viscosity

The lubricating oil compositions disclosed herein generally comprise at least one oil of lubricating viscosity. Any base oil known to a skilled artisan can be used as the oil of lubricating viscosity disclosed herein. Some base oils suitable for preparing the lubricating oil compositions have been described in Mortier et al., "*Chemistry and Technology of Lubricants,*" 2nd Edition, London, Springer, Chapters 1 and 2 (1996); and A. Sequeria, Jr., "*Lubricant Base Oil and Wax Processing*," New York, Marcel Decker, Chapter 6, (1994); and D. V. Brock, *Lubrication Engineering*, Vol. 43, pages 184-5, (1987), all of which are incorporated herein by reference. Generally, the amount of the base oil in the lubricating oil composition may be from about 70 to about 99.5 wt. %, based on the total weight of the lubricating oil composition. In some embodiments, the amount of the base oil in the lubricating oil composition is from about 75 to about 99 wt. %, from about 80 to about 98.5 wt. %, or from about 80 to about 98 wt. %, based on the total weight of the lubricating oil composition.

In certain embodiments, the base oil is or comprises any natural or synthetic lubricating base oil fraction. Some non-limiting examples of synthetic oils include oils, such as polyalphaolefins or PAOs, prepared from the polymerization of at least one alpha-olefin, such as ethylene, or from hydrocarbon synthesis procedures using carbon monoxide and hydrogen gases, such as the Fisher-Tropsch process. In certain embodiments, the base oil comprises less than about 10 wt. % of one or more heavy fractions, based on the total weight of the base oil. A heavy fraction refers to a lube oil fraction having a viscosity of at least about 20 cSt at 100° C. In certain embodiments, the heavy fraction has a viscosity of at least about 25 cSt or at least about 30 cSt at 100° C. In further embodiments, the amount of the one or more heavy fractions in the base oil is less than about 10 wt. %, less than about 5 wt. %, less than about 2.5 wt. %, less than about 1 wt. %, or less than about 0.1 wt. %, based on the total weight of the base oil. In still further embodiments, the base oil comprises no heavy fraction.

In certain embodiments, the lubricating oil compositions comprise a major amount of a base oil of lubricating viscosity. In some embodiments, the base oil has a kinematic viscosity at 100° C. from about 2.5 centistokes (cSt) to about 20 cSt, from about 5 centistokes (cSt) to about 20 cSt, from about 7 cSt to about 16 cSt, or from about 9 cSt to about 15 cSt. The kinematic viscosity of the base oils or the lubricating oil compositions disclosed herein can be measured according to ASTM D 445, which is incorporated herein by reference.

In other embodiments, the base oil is or comprises a base stock or blend of base stocks. In further embodiments, the base stocks are manufactured using a variety of different processes including, but not limited to, distillation, solvent refining, hydrogen processing, oligomerization, esterification, and rerefining. In some embodiments, the base stocks comprise a rerefined stock. In further embodiments, the rerefined stock shall be substantially free from materials introduced through manufacturing, contamination, or previous use.

In some embodiments, the base oil comprises one or more of the base stocks in one or more of Groups I-V as specified in the American Petroleum Institute (API) Publication 1509, Seventeen Edition, September 2012 (i.e., API Base Oil Interchangeability Guidelines for Passenger Car Motor Oils and Diesel Engine Oils), which is incorporated herein by reference. The API guideline defines a base stock as a lubricant component that may be manufactured using a variety of different processes. Groups I, II and III base stocks are mineral oils, each with specific ranges of the amount of saturates, sulfur content and viscosity index. Group IV base stocks are polyalphaolefins (PAO). Group V base stocks include all other base stocks not included in Group I, II, III, or IV.

The saturates levels, sulfur levels and viscosity indices for Group I, II and III base stocks are listed in Table 1 below.

TABLE 1

| Group | Saturates (As determined by ASTM D 2007) | Sulfur(As determined by ASTM D 4294, ASTM D 4297 or ASTM D 3120) | Viscosity Index (As determined by ASTM D 2270) |
|---|---|---|---|
| I | Less than 90% saturates. | Greater than 0.03% sulfur. | Greater than or equal to 80 and less than 120. |
| II | Greater than or equal to 90% saturates. | Less than or equal to 0.03% sulfur. | Greater than or equal to 80 and less than 120. |
| III | Greater than or equal to 90% saturates. | Less than or equal to 0.03% sulfur. | Greater than or equal to 120. |

In some embodiments, the base oil comprises one or more of the base stocks in Group I, II, III, IV, V or a combination thereof. In other embodiments, the base oil comprises one or more of the base stocks in Group II, III, IV or a combination thereof. In further embodiments, the base oil comprises one or more of the base stocks in Group II, III, IV or a combination thereof wherein the base oil has a kinematic viscosity from about 4 centistokes (cSt) to about 20 cSt, from about 7 cSt to about 16 cSt, or from about 9 cSt to about 15 cSt at 100° C.

The base oil may be selected from the group consisting of natural oils of lubricating viscosity, synthetic oils of lubricating viscosity and mixtures thereof. In some embodiments, the base oil includes base stocks obtained by isomerization of synthetic wax and slack wax, as well as hydrocrackate base stocks produced by hydrocracking (rather than solvent extracting) the aromatic and polar components of the crude. In other embodiments, the base oil of lubricating viscosity includes natural oils, such as animal oils, vegetable oils, mineral oils, oils derived from coal or shale, and combinations thereof. Some non-limiting examples of animal oils include bone oil, lanolin, fish oil, lard oil, dolphin oil, seal oil, shark oil, tallow oil, and whale oil. Some non-limiting examples of vegetable oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and meadow foam oil. Such oils may be partially or fully hydrogenated. Some non-limiting examples of mineral oils include Groups I, II, and III base stocks, liquid petroleum oils and solvent treated or acid-treated mineral oils of the paraffinic, naphthenic or mixed paraffinic-naphthenic types. In some embodiments, the mineral oils are neat or low viscosity mineral oils.

In some embodiments, the synthetic oils of lubricating viscosity include hydrocarbon oils and halo-substituted hydrocarbon oils such as polymerized and inter-polymerized olefins, alkylbenzenes, polyphenyls, alkylated diphenyl ethers, alkylated diphenyl sulfides, as well as their derivatives, analogues and homologues thereof, and the like. In other embodiments, the synthetic oils include alkylene oxide polymers, interpolymers, copolymers and derivatives thereof wherein the terminal hydroxyl groups can be modified by esterification, etherification, and the like. In further embodiments, the synthetic oils include the esters of dicarboxylic acids with a variety of alcohols. In certain embodiments, the synthetic oils include esters made from $C_5$ to $C_{12}$ monocarboxylic acids and polyols and polyol ethers. In further embodiments, the synthetic oils include tri-alkyl phosphate ester oils, such as tri-n-butyl phosphate and tri-iso-butyl phosphate.

In some embodiments, the synthetic oils of lubricating viscosity include silicon-based oils (such as the polyalkyl-, polyaryl-, polyalkoxy-, polyaryloxy-siloxane oils and silicate oils). In other embodiments, the synthetic oils include liquid esters of phosphorus-containing acids, polymeric tetrahydrofurans, polyalphaolefins, and the like.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

In further embodiments, the base oil comprises a poly-alpha-olefin (PAO). In general, the poly-alpha-olefins may be derived from an alpha-olefin having from about 2 to about 30, from about 4 to about 20, or from about 6 to about 16 carbon atoms. Non-limiting examples of suitable poly-alpha-olefins include those derived from octene, decene, mixtures thereof, and the like. These poly-alpha-olefins may have a viscosity from about 2 to about 15, from about 3 to about 12, or from about 4 to about 8 centistokes at 100° C. In some instances, the poly-alpha-olefins may be used together with other base oils such as mineral oils.

In further embodiments, the base oil comprises a polyalkylene glycol or a polyalkylene glycol derivative, where the terminal hydroxyl groups of the polyalkylene glycol may be modified by esterification, etherification, acetylation and the like. Non-limiting examples of suitable polyalkylene glycols include polyethylene glycol, polypropylene glycol, polyisopropylene glycol, and combinations thereof. Non-limiting examples of suitable polyalkylene glycol derivatives include ethers of polyalkylene glycols (e.g., methyl ether of polyisopropylene glycol, diphenyl ether of polyethylene glycol, diethyl ether of polypropylene glycol, etc.), mono- and polycarboxylic esters of polyalkylene glycols, and combinations thereof. In some instances, the polyalkylene glycol or polyalkylene glycol derivative may be used together with other base oils such as poly-alpha-olefins and mineral oils.

In further embodiments, the base oil comprises any of the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, and the like) with a variety of alcohols (e.g., butyl alcohol, hexyl alcohol, dodecyl alcohol, 2-ethylhexyl alcohol, ethylene glycol, diethylene glycol monoether, propylene glycol, and the like). Non-limiting examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the like.

In further embodiments, the base oil comprises a hydrocarbon prepared by the Fischer-Tropsch process. The Fischer-Tropsch process prepares hydrocarbons from gases containing hydrogen and carbon monoxide using a Fischer-Tropsch catalyst. These hydrocarbons may require further processing in order to be useful as base oils. For example, the hydrocarbons may be dewaxed, hydroisomerized, and/or hydrocracked using processes known to a person of ordinary skill in the art.

In further embodiments, the base oil comprises an unrefined oil, a refined oil, a rerefined oil, or a mixture thereof. Unrefined oils are those obtained directly from a natural or synthetic source without further purification treatment. Non-limiting examples of unrefined oils include shale oils obtained directly from retorting operations, petroleum oils obtained directly from primary distillation, and ester oils obtained directly from an esterification process and used without further treatment. Refined oils are similar to the unrefined oils except the former have been further treated by one or more purification processes to improve one or more properties. Many such purification processes are known to those skilled in the art such as solvent extraction, secondary distillation, acid or base extraction, filtration, percolation, and the like. Rerefined oils are obtained by applying to refined oils processes similar to those used to obtain refined oils. Such rerefined oils are also known as reclaimed or reprocessed oils and often are additionally treated by processes directed to removal of spent additives and oil breakdown products.

Additional Lubricating Oil Additives

Optionally, the lubricating oil composition of the present invention may further comprise at least an additive or a modifier (hereinafter designated as "additive") that can impart or improve any desirable property of the lubricating oil composition. Any additive known to a person of ordinary skill in the art may be used in the lubricating oil compositions disclosed herein. Some suitable additives have been described in Mortier et al., "*Chemistry and Technology of Lubricants,*" 2nd Edition, London, Springer, (1996); and Leslie R. Rudnick, "*Lubricant Additives: Chemistry and Applications*," New York, Marcel Dekker (2003), both of which are incorporated herein by reference.

In some embodiments, the additive can be selected from the group consisting of antioxidants, antiwear agents, detergents, rust inhibitors, demulsifiers, friction modifiers, multifunctional additives, viscosity index improvers, pour point depressants, foam inhibitors, metal deactivators, dispersants, corrosion inhibitors, lubricity improvers, thermal stability improvers, anti-haze additives, icing inhibitors, dyes, markers, static dissipaters, biocides and combinations thereof. A variety of the additives are known and commercially available. These additives, or their analogous compounds, may be employed for the preparation of the lubricating oil compositions of the invention by the usual blending procedures.

Examples of antioxidants include, but are not limited to, aminic types, e.g., diphenylamine, phenyl-alpha-napthylamine, N,N-di(alkylphenyl)amines; and alkylated phenylene-diamines; phenolics such as, for example, BHT, sterically hindered alkyl phenols such as 2,6-di-tert-butylphenol, 2,6-di-tert-butyl-p-cresol and 2,6-di-tert-butyl-4-(2-octyl-3-propanoic) phenol; and mixtures thereof.

Examples of antiwear agents include, but are not limited to, zinc dialkyldithiophosphates and zinc diaryldithiophosphates, e.g., those described in an article by Born et al. entitled "Relationship between Chemical Structure and Effectiveness of some Metallic Dialkyl- and Diaryl-dithiophosphates in Different Lubricated Mechanisms", appearing in Lubrication Science 4-2 Jan. 1992, see for example pages 97-100; aryl phosphates and phosphites, sulfur-containing esters, phosphosulfur compounds, metal or ash-free dithiocarbamates, xanthates, alkyl sulfides and the like and mixtures thereof.

Representative examples of ashless dispersants include, but are not limited to, amines, alcohols, amides, or ester polar moieties attached to a polymer backbone via bridging groups. An ashless dispersant of the present invention may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

Carboxylic dispersants are reaction products of carboxylic acylating agents (acids, anhydrides, esters, etc.) comprising at least about 34 and preferably at least about 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, esters, and salts.

Succinimide dispersants are a type of carboxylic dispersant. They are produced by reacting hydrocarbyl-substituted succinic acylating agent with organic hydroxy compounds, or with amines comprising at least one hydrogen atom attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

Succinic-based dispersants have a wide variety of chemical structures. One class of succinic-based dispersants may be represented by Formula 1:

Formula 1

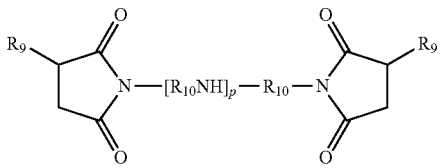

wherein each $R_9$ is independently a hydrocarbyl group, such as a polyolefin-derived group. Typically the hydrocarbyl group is an alkenyl group, such as a polyisobutenyl group. Alternatively expressed, the $R_9$ groups can contain about 40 to about 500 carbon atoms, and these atoms may be present in aliphatic forms. $R_{10}$ is an alkylene group, commonly an ethylene ($C_2H_4$) group; and p is 1 to 11. Examples of succinimide dispersants include those described in, for example, U.S. Pat. Nos. 3,172,892, 4,234,435 and 6,165,235.

The polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines.

Succinimide dispersants are referred to as such since they normally contain nitrogen largely in the form of imide functionality, although the nitrogen functionality may be in the form of amines, amine salts, amides, imidazolines as well as mixtures thereof. To prepare a succinimide dispersant, one or more succinic acid-producing compounds and one or more amines are heated and typically water is removed, optionally in the presence of a substantially inert organic liquid solvent/diluent. The reaction temperature can range from about 80° C. up to the decomposition temperature of the mixture or the product, which typically falls between about 100° C. to about 300° C. Additional details and examples of procedures for preparing the succinimide dispersants of the present invention include those described in, for example, U.S. Pat. Nos. 3,172,892, 3,219,666, 3,272,746, 4,234,435, 6,165,235 and 6,440,905.

Suitable ashless dispersants may also include amine dispersants, which are reaction products of relatively high molecular weight aliphatic halides and amines, preferably polyalkylene polyamines. Examples of such amine dispersants include those described in, for example, U.S. Pat. Nos. 3,275,554, 3,438,757, 3,454,555 and 3,565,804.

Suitable ashless dispersants may further include "Mannich dispersants," which are reaction products of alkyl phenols in which the alkyl group contains at least about 30 carbon atoms with aldehydes (especially formaldehyde) and amines (especially polyalkylene polyamines). Examples of such dispersants include those described in, for example, U.S. Pat. Nos. 3,036,003, 3,586,629, 3,591,598 and 3,980,569.

Suitable ashless dispersants may also be post-treated ashless dispersants such as post-treated succinimides, e.g., post-treatment processes involving borate or ethylene carbonate as disclosed in, for example, U.S. Pat. Nos. 4,612,132 and 4,746,446; and the like as well as other post-treatment processes. The carbonate-treated alkenyl succinimide is a polybutene succinimide derived from polybutenes having a molecular weight of about 450 to about 3000, preferably from about 900 to about 2500, more preferably from about 1300 to about 2400, and most preferably from about 2000 to about 2400, as well as mixtures of these molecular weights.

An ashless dispersant can be prepared by reacting, under reactive conditions, a mixture of a polybutene succinic acid derivative, an unsaturated acidic reagent copolymer of an unsaturated acidic reagent and an olefin, and a polyamine, such as disclosed in U.S. Pat. No. 5,716,912, the contents of which are incorporated herein by reference.

Suitable ashless dispersants may also be polymeric, which are interpolymers of oil-solubilizing monomers such as decyl methacrylate, vinyl decyl ether and high molecular weight olefins with monomers containing polar substitutes. Examples of polymeric dispersants include those described in, for example, U.S. Pat. Nos. 3,329,658; 3,449,250 and 3,666,730.

Generally, the one or more ashless dispersants are present in the lubricating oil composition in an amount ranging from about 0.01 wt. % to about 10 wt. %, based on the total weight of the lubricating oil composition.

Representative examples of metal detergents include sulfonates, alkylphenates, sulfurized alkyl phenates, carboxylates, salicylates, phosphonates, and phosphinates. Commercial products are generally referred to as neutral or overbased. Overbased metal detergents are generally produced by carbonating a mixture of hydrocarbons, detergent acid, for example: sulfonic acid, alkylphenol, carboxylate etc., metal oxide or hydroxides (for example calcium oxide or calcium hydroxide) and promoters such as xylene, methanol and water. For example, for preparing an overbased calcium sulfonate, in carbonation, the calcium oxide or hydroxide reacts with the gaseous carbon dioxide to form calcium carbonate. The sulfonic acid is neutralized with an excess of CaO or $Ca(OH)_2$, to form the sulfonate.

Other examples of suitable detergents include borated sulfonates. In general, a borated sulfonate for use herein can be any borated sulfonate known in the art. A borated sulfonate for use herein can have a total base number (TBN) of from about 10 to about 500. In one embodiment, a borated sulfonate has a TBN is from about 10 to about 100. In one embodiment, a borated sulfonate has a TBN is from about 100 to about 250. In one embodiment, a borated sulfonate has a TBN of from about 250 to about 500.

The borated alkaline earth metal sulfonates can be prepared by methods known in the art, e.g., as disclosed in U.S. Patent Application Publication No. 20070123437, the contents of which are incorporated by reference herein. For example, the borated alkaline earth metal sulfonate is prepared in the following manner: (a) reacting (i) at least one of an oil soluble sulfonic acid or alkaline earth sulfonate salt or mixtures thereof; (ii) at least one source of an alkaline earth metal; and (iii) at least one source of boron, in the presence of (iv) at least one hydrocarbon solvent; and (v) from 0 to less than 10 mole percent, relative to the source of boron, of an overbasing acid, other than the source of boron; and (b) heating the reaction product of (a) to a temperature above the distillation temperature of (iv) to distill (iv) and water of reaction.

Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and would typically have a total base number or TBN (as can be measured by ASTM D2896) of from 0 to about 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g., carbonate) micelle. Such overbased detergents may have a TBN of about 150 or greater, and typically will have a TBN of from about 250 to about 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from about 20 to about 450, neutral and overbased calcium phenates and sulfurized phenates having TBN of from about 50 to about 450 and neutral and overbased magnesium or calcium salicylates having a TBN of from about 20 to about 450. Combinations of detergents, whether overbased or neutral or both, may be used.

In one embodiment, the detergent can be one or more alkali or alkaline earth metal salts of an alkyl-substituted hydroxyaromatic carboxylic acid. Suitable hydroxyaromatic compounds include mononuclear monohydroxy and polyhydroxy aromatic hydrocarbons having 1 to 4, and preferably 1 to 3, hydroxyl groups. Suitable hydroxyaromatic compounds include phenol, catechol, resorcinol, hydroquinone, pyrogallol, cresol, and the like. The preferred hydroxyaromatic compound is phenol.

The alkyl substituted moiety of the alkali or alkaline earth metal salt of an alkyl-substituted hydroxyaromatic carboxylic acid is derived from an alpha olefin having from about 10 to about 80 carbon atoms. The olefins employed may be linear or branched. The olefin may be a mixture of linear olefins, a mixture of isomerized linear olefins, a mixture of branched olefins, a mixture of partially branched linear or a mixture of any of the foregoing.

In one embodiment, the mixture of linear olefins that may be used is a mixture of normal alpha olefins selected from olefins having from about 12 to about 30 carbon atoms per molecule. In one embodiment, the normal alpha olefins are isomerized using at least one of a solid or liquid catalyst.

In another embodiment, the olefins are a branched olefinic propylene oligomer or mixture thereof having from about 20 to about 80 carbon atoms, i.e., branched chain olefins derived from the polymerization of propylene. The olefins may also be substituted with other functional groups, such as hydroxy groups, carboxylic acid groups, heteroatoms, and the like. In one embodiment, the branched olefinic propylene oligomer or mixtures thereof have from about 20 to about 60 carbon atoms. In one embodiment, the branched olefinic propylene oligomer or mixtures thereof have from about 20 to about 40 carbon atoms.

In one embodiment, at least about 75 mole % (e.g., at least about 80 mole %, at least about 85 mole %, at least about 90 mole %, at least about 95 mole %, or at least about 99 mole %) of the alkyl groups contained within the alkali or alkaline earth metal salt of an alkyl-substituted hydroxyaromatic carboxylic acid such as the alkyl groups of an alkaline earth metal salt of an alkyl-substituted hydroxybenzoic acid detergent are a $C_{20}$ or higher. In another embodiment, the alkali or alkaline earth metal salt of an alkyl-substituted hydroxyaromatic carboxylic acid is an alkali or alkaline earth metal salt of an alkyl-substituted hydroxybenzoic acid that is derived from an alkyl-substituted hydroxybenzoic acid in which the alkyl groups are the residue of normal alpha-olefins containing at least 75 mole % $C_{20}$ or higher normal alpha-olefins.

In another embodiment, at least about 50 mole % (e.g., at least about 60 mole %, at least about 70 mole %, at least about 80 mole %, at least about 85 mole %, at least about 90 mole %, at least about 95 mole %, or at least about 99 mole %) of the alkyl groups contained within the alkali or alkaline earth metal salt of an alkyl-substituted hydroxyaromatic carboxylic acid such as the alkyl groups of an alkali or alkaline earth metal salt of an alkyl-substituted hydroxybenzoic acid are about $C_{14}$ to about $C_{18}$.

The resulting alkali or alkaline earth metal salt of an alkyl-substituted hydroxyaromatic carboxylic acid will be a mixture of ortho and para isomers. In one embodiment, the product will contain about 1 to 99% ortho isomer and 99 to 1% para isomer. In another embodiment, the product will contain about 5 to 70% ortho and 95 to 30% para isomer.

The alkali or alkaline earth metal salts of an alkyl-substituted hydroxyaromatic carboxylic acid can be neutral or overbased. Generally, an overbased alkali or alkaline earth metal salt of an alkyl-substituted hydroxyaromatic carboxylic acid is one in which the TBN of the alkali or alkaline earth metal salts of an alkyl-substituted hydroxyaromatic carboxylic acid has been increased by a process such as the addition of a base source (e.g., lime) and an acidic overbasing compound (e.g., carbon dioxide).

Overbased salts may be low overbased, e.g., an overbased salt having a TBN below about 100. In one embodiment, the TBN of a low overbased salt may be from about 5 to about 50. In another embodiment, the TBN of a low overbased salt may be from about 10 to about 30. In yet another embodiment, the TBN of a low overbased salt may be from about 15 to about 20.

Overbased detergents may be medium overbased, e.g., an overbased salt having a TBN from about 100 to about 250. In one embodiment, the TBN of a medium overbased salt may be from about 100 to about 200. In another embodiment, the TBN of a medium overbased salt may be from about 125 to about 175.

Overbased detergents may be high overbased, e.g., an overbased salt having a TBN above about 250. In one embodiment, the TBN of a high overbased salt may be from about 250 to about 450.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates and borates. The amount of metal compound is chosen having regard to the desired TBN of the final product but typically ranges from about 100 to about 220 wt. % (preferably at least about 125 wt. %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Generally, the one or more detergents are present in the lubricating oil composition in an amount ranging from about 0.01 wt. % to about 10 wt. %, based on the total weight of the lubricating oil composition.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are herein incorporated by reference; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine and the like and mixtures thereof.

Examples of antifoaming agents include, but are not limited to, polymers of alkyl methacrylate; polymers of dimethylsilicone and the like and mixtures thereof.

Examples of a pour point depressant include, but are not limited to, polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In one embodiment, a pour point depressant comprises an ethylene-vinyl acetate copolymer, a condensate of chlorinated paraffin and phenol, polyalkyl styrene and the like and combinations thereof. The amount of the pour point depressant may vary from about 0.01 wt. % to about 10 wt. %.

Examples of a demulsifier include, but are not limited to, anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and the like and combinations thereof. The amount of the demulsifier may vary from about 0.01 wt. % to about 10 wt. %.

Examples of a corrosion inhibitor include, but are not limited to, half esters or amides of dodecylsuccinic acid, phosphate esters, thiophosphates, alkyl imidazolines, sarcosines and the like and combinations thereof. The amount of the corrosion inhibitor may vary from about 0.01 wt. % to about 5 wt. %.

Examples of an extreme pressure agent include, but are not limited to, sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and the like and combinations thereof. The amount of the extreme pressure agent may vary from about 0.01 wt. % to about 5 wt. %.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, may range, unless otherwise specified, from about 0.001 wt. % to about 10 wt. %, in one embodiment from about 0.005 wt. % to about 5 wt. %, or in one embodiment from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

The final application of the lubricating oil compositions of the present invention may be, for example, in railroads engines and the like, marine cylinder lubricants in crosshead diesel engines, crankcase lubricants, in automobiles, lubricants for heavy machinery such as steel mills and the like, or as greases for bearings and the like. Whether the lubricating oil composition is fluid or solid will ordinarily depend on whether a thickening agent is present. Typical thickening agents include polyurea acetates, lithium stearate and the like.

In another embodiment of the invention, the lubricating oil compositions of the present invention may be provided as an additive package or concentrate in which the additive is incorporated into a substantially inert, normally liquid organic diluent such as, for example, mineral oil, naphtha, benzene, toluene or xylene to form an additive concentrate. These concentrates usually contain from about 20% to about 80% by weight of such diluent. Typically, a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used. The additive package will also typically contain one or more of the various other additives, referred to above, in the desired amounts and ratios to facilitate direct combination with the requisite amount of base oil.

The following examples are presented to exemplify embodiments of the invention but are not intended to limit the invention to the specific embodiments set forth. Unless indicated to the contrary, all parts and percentages are by weight. All numerical values are approximate. When numerical ranges are given, it should be understood that embodiments outside the stated ranges may still fall within the scope of the invention. Specific details described in each example should not be construed as necessary features of the invention.

EXAMPLES

The following examples are intended for illustrative purposes only and do not limit in any way the scope of the present invention.

Lubricating oil composition formulations were prepared as described in Table II below for evaluating the silver lubricity additive composition of the present invention using the Silver Wear and Friction Test. All units are in weight %.

Silver Wear Evaluation Using a Silver Disk Wear and Friction Test (Amoco Modified Silver Disc Wear and Friction Test)

The lubricating oil additives of Comparative Examples A to E and Test Examples 1 to 3 were evaluated using the Amoco modified Silver Disc Wear and Friction Test. Eight formulations (Table II) were tested in what is known to those skilled in the art as the Amoco modified Silver Disc Wear and Friction Test. This wear test procedure is a laboratory test for determining the anti-wear properties of lubricant oil. The test machine comprises a system wherein a one-half inch diameter 52100 steel ball is placed in assembly with three one-quarter inch silver discs of like size and of a quality identical to that employed in the plating of the silver pin insert bearing or railway diesel engines manufactured by the Electromotive Division (EMD) of General Motors, In. These discs are in a fixed triangular position in a reservoir containing the oil sample to be tested for its silver antiwear properties. The steel ball is positioned above and in contact with the three silver discs. In carrying out these tests, the ball is rotated while it is pressed against the three discs at the pressure specified and by means of a suitable weight applied to a lever arm. The test results are determined by using a low power microscope to examine and measure the scars on the discs. A wear scar diameter of 2.2 m or less is considered to indicate adequate silver wear protection. The rotation of the steel ball on the silver discs proceeds for a period of 30 min at 600 revolutions per minutes under a 23 kilogram static load. Each oil was tested at 500 F. The coefficient of friction is measured for each formulation.

The Silver Disk Wear and Friction Test data are summarized in Table III below. The data obtained for Formulation A was used as the baseline.

TABLE III

| Formulation | Wear Scar (mm) | Friction |
|---|---|---|
| Comparative Example A | 1.873 | 0.125 |
| Comparative Example B | 1.696 | 0.114 |

TABLE II

| Component | Comp. Ex. A | Comp. Ex. B | Comp. Ex. C | Comp. Ex. D | Comp. Ex. E | Test Ex. 1 | Test Ex. 2 | Test Ex. 3 |
|---|---|---|---|---|---|---|---|---|
| Dispersant A | 0.5 | 0.5 | 0.5 | — | — | 0.5 | — | — |
| Dispersant B | 2.5 | 2.5 | 2.5 | 3.0 | 3.0 | 2.5 | 3.0 | 3.0 |
| Detergent A | 1.84 | 1.84 | 1.84 | 1.89 | 1.80 | 1.84 | 1.89 | 1.80 |
| Detergent B | 2.83 | 2.83 | 2.83 | 1.13 | 2.83 | 2.83 | 1.13 | 2.83 |
| Detergent C | — | — | — | 1.12 | 0.96 | — | 1.12 | 0.96 |
| Detergent D | — | — | — | 1.80 | 1.00 | — | 1.80 | 1.00 |
| Antioxidant A | 0.10 | 0.10 | 0.10 | 0.50 | 0.15 | 0.10 | 0.50 | 0.15 |
| Antioxidant B | 0.10 | 0.10 | 0.10 | 0.20 | 0.15 | 0.10 | 0.20 | 0.15 |
| Corrosion Inhibitor | 0.20 | 0.20 | 0.20 | — | — | 0.20 | — | — |
| Foam Inhibitor | 0.0003 | 0.0003 | 0.0003 | 0.0003 | 0.0003 | 0.0003 | 0.0003 | 0.0003 |
| Phosphate Amine salt | — | 0.10 | — | — | 0.20 | — | — | — |
| Glycerol Monooleate | — | — | 0.20 | — | — | — | — | — |
| Borated Glycerol Monooleate | — | — | — | — | — | 0.20 | 0.20 | 0.20 |
| Base Oil A | 4.58 | 4.58 | 4.57 | 4.49 | 4.47 | 4.58 | 4.48 | 4.47 |
| Base Oil B | 86.93 | 86.93 | 86.74 | 85.36 | 84.92 | 86.93 | 85.16 | 84.92 |
| Total | 100 | 100 | 100 | 100 | 100 | 100 | 100 | 100 |

Comparative Example A = With no silver lubricity agent.
Comparative Example B = With phosphate amine salt.
Comparative Example C = With Glycerol monooleate.
Comparative Example D = With no silver lubricity agent.

TABLE III-continued

| Formulation | Wear Scar (mm) | Friction |
|---|---|---|
| Comparative Example C | 1.873 | 0.0909 |
| Comparative Example D | 1.968 | 0.1412 |
| Comparative Example E | 2.067 | 0.1141 |
| Test Example 1 | 1.750 | 0.0907 |
| Test Example 2 | 1.796 | 0.0983 |
| Test Example 3 | 1.837 | 0.1022 |

As the results illustrated in Table III show, the lubricating oil compositions of the present invention (Examples 1 to 3), demonstrate significantly better anti-wear performance and significantly better anti-friction properties over the baseline formulation (Comparative Example A) and Comparative Examples B to E.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A method for reducing silver bearing wear and friction in a railroad diesel engine containing silver or silver surfaced bearing components, said method comprising lubricating said railroad diesel engine with a lubricating oil composition comprising:

(a) a major amount of an oil of lubricating viscosity; and (b) 0.15 to 1.5 weight percent of a silver lubricity borated fatty acid ester, wherein the silver lubricity borated fatty acid ester is an ester of glycerol and a $C_{12}$-$C_{22}$ carboxylic acid containing 0 to 3 double bonds.

2. The method of claim 1 wherein the silver lubricity borated fatty acid ester is borated glycerol monooleate.

3. The method of claim 1 wherein the silver lubricity borated fatty acid ester additive is present at 0.15 to 1.0 weight percent.

4. The method of claim 1 wherein the silver lubricity borated fatty acid ester additive is present at 0.15 to 0.5 weight percent.

5. The method of claim 1 wherein the silver lubricity borated fatty acid ester additive is present at 0.20 weight percent.

6. The method of claim 1 wherein the carboxylic acid is selected from the group comprising oleic, stearic, isostearic, palmitic, myristic, palmitoleic, linoleic, lanric, linolenic, and eleostearic acids.

7. The method of claim 6 wherein the carboxylic acid is oleic acid.

* * * * *